US006012989A

United States Patent [19]

Saksun, Sr.

[11] Patent Number: 6,012,989

[45] Date of Patent: Jan. 11, 2000

[54] GOLF CLUB HEAD

[76] Inventor: John Saksun, Sr., 8 Rangemore Road, Toronto, Ontario, Canada, M8Z 5H7

[21] Appl. No.: 08/955,801

[22] Filed: Oct. 22, 1997

[51] Int. Cl.[7] ..... A63B 53/04

[52] U.S. Cl. ..... 473/341; 473/342; 473/305

[58] Field of Search ..... 473/305, 324, 473/340, 341, 342, 347, 348, 349, 329

[56] References Cited

U.S. PATENT DOCUMENTS

| | | | |
|---|---|---|---|
| 645,942 | 3/1900 | Cran | 273/171 |
| 690,940 | 1/1902 | Febiger | 273/170 |
| 1,318,325 | 10/1919 | Klin | 273/171 |
| 1,453,503 | 5/1923 | Holmes | 273/171 |
| 3,064,980 | 11/1962 | Steiner | 273/171 |
| 3,516,674 | 6/1970 | Scarborough | 273/169 |
| 3,652,094 | 3/1972 | Glover | 273/171 |
| 3,810,621 | 5/1974 | Mills | 473/309 |
| 3,845,960 | 11/1974 | Thompson | 273/171 |
| 3,966,210 | 6/1976 | Rozmus | 273/169 |
| 3,979,122 | 9/1976 | Belmont | 273/171 |
| 4,180,269 | 12/1979 | Thompson | 273/171 |
| 4,340,230 | 7/1982 | Chruchward | 273/171 |
| 4,343,472 | 8/1982 | Hamilton | 273/164 |
| 4,422,638 | 12/1983 | Tucker | 273/78 |
| 4,580,784 | 4/1986 | Brill | 273/162 |
| 4,607,846 | 8/1986 | Perkins | 273/171 |
| 4,618,149 | 10/1986 | Maxel | 273/79 |
| 4,650,191 | 3/1987 | Mills | 273/164 |
| 4,655,459 | 4/1987 | Antonious | 273/171 |
| 4,741,535 | 5/1988 | Leonhardt | 273/164 |
| 4,852,879 | 8/1989 | Collins | 273/164 |
| 4,871,174 | 10/1989 | Kobayashi | 273/164 |
| 4,898,387 | 2/1990 | Finney | 273/167 |
| 4,936,582 | 6/1990 | Bernstein | 273/162 |
| 5,004,241 | 4/1991 | Antonious | 473/327 |
| 5,083,778 | 1/1992 | Douglass | 273/78 |
| 5,116,047 | 5/1992 | Phelan et al. | 273/80.1 |
| 5,253,869 | 10/1993 | Dingle et al. | 273/80.1 |
| 5,409,219 | 4/1995 | Saksun, Sr. | 273/79 |
| 5,429,358 | 7/1995 | Rigal et al. | 473/309 |
| 5,524,890 | 6/1996 | Kim et al. | 473/327 |

*Primary Examiner*—Kien T. Nguyen

[57] ABSTRACT

A golf club head for use in a golf club. The club head has a moulded main body with weighted inserts to improve striking characteristics. The club head includes a shaft anchoring element to attach the club head to a golf club shaft. In one embodiment the club head includes a hardened insert to form a striking face on the golf club. In a further embodiment, the golf club head is formed during a two-step process, first the moulding of a main body, then, the moulding of a insert to form a front face.

25 Claims, 3 Drawing Sheets

GOLF CLUB HEAD

FIELD OF THE INVENTION

This invention relates to sporting equipment, and more particularly to golf equipment. Most particularly, this relates to a golf club and the head therefor.

BACKGROUND OF THE INVENTION

Golf clubs have changed dramatically over the years. Originally, the longer hitting clubs were made from wood and hence are referred to as "woods." New materials have become available which have been applied to the art of golf club manufacturing. For example club heads are now made from metal, and are called metal woods. Additionally graphite shafts are now used where once steel shafts were used.

With the new materials have also come new design shapes and sizes. Most dramatically, has been the trend over the recent few years to use a larger sized club head which allegedly results in a larger sweet spot and hopefully longer and more consistent drives. However, such larger club heads tend to be expensive and can in the hands of a less skilled player produce inconsistent results.

Another trend in the past has been to design better weighted clubs. For example, the concept of perimeter weighting a club face has been used in the design of irons to improve club performance. Weighted golf club heads have also been proposed for the woods in which weights are carried in the body of the club head to improve the hitting characteristics of the club head when making contact with the ball. For example, my own prior patent U.S. Pat. No. 5,409,219 is directed to a moulded golf club head having a C-shaped configuration when viewed from above. Weights are carried in two rearward extensions of the moulded body which includes a front striking face. This prior club provides good hitting characteristics, because of a high moment of inertia along the arc of the swing. This prior design may also have problems with club head integrity. The moulded material tends to crack, releasing the club head from the shaft, and the weighted extensions from the body. Consequently, although delivering good performance in ball striking, improvements were required both in the design and shape of the club head and in the manner that the club head is secured to a golf club shaft to complete a golf club.

Other patents directed to weighted golf club heads include:

U.S. Pat. No. 645,942 to Cran issued March 1900;
U.S. Pat. No. 690,940 to Febiger issued January 1902;
U.S. Pat. No. 1,318,325 to Klin issued October 1919;
U.S. Pat. No. 1,453,503 to Holmes issued May 1923;
U.S. Pat. No. 3,064,980 to Steiner issued November 1962;
U.S. Pat. No. 3,652,094 to Glover issued March 1972;
U.S. Pat. No. 3,845,960 to Thompson issued November 1974;
U.S. Pat. No. 3,966,210 to Rozmus issued June 1976;
U.S. Pat. No. 3,979,122 to Belmont issued September 1976;
U.S. Pat. No. 4,340,230 to Churchward issued July 1982;
U.S. Pat. No. 4,343,472 to Hamilton issued August 1982;
U.S. Pat. No. 4,422,638 to Tucker issued December 1983;
U.S. Pat. No. 4,580,784 to Brill issued April 1986;
U.S. Pat. No. 4,607,846 to Perkins issued August 1986;
U.S. Pat. No. 4,618,149 to Maxel issued October 1986;
U.S. Pat. No. 4,655,459 to Antonious issued April 1987;
U.S. Pat. No. 4,852,879 to Collins issued August 1989;
U.S. Pat. No. 4,871,174 to Kobayashi issued October 1989;
U.S. Pat. No. 4,898,387 to Finney issued February 1990;
U.S. Pat. No. 4,936,582 to Bernstein issued June 1990;

U.S. Pat. No. 5,083,778 to Douglass issued January 1992;
U.S. Pat. No. 5,116,047 to Phelan issued May 1992; and
U.S. Pat. No. 5,253,869 to Dingle issued October 1993.

SUMMARY OF THE INVENTION

According to the present invention there is provided a golf club head for attaching to a golf club shaft which addresses these concerns. The main body of the club head is moulded and therefore is inexpensive to produce. Moulded into the main body are weights, which are positioned to improve the reaction of the club to twisting forces which normally arise upon contacting the ball. Also moulded into the body is a shaft receiving bore, with an associated hozzle.

Another aspect of the present invention is the use of a shaft attachment device which may be securely and permanently attached to the body, by being moulded into the body, and which may also securely receive the shaft to form a complete golf club. In a preferred embodiment, this attachment device comprises a hollow cylinder of aluminum, which is provided with surface irregularities on an outer surface to form a strong bond with the mouldable material of the main body. The inner surface is smooth and sized and shaped to closely receive a golf club shaft therein. This facilitates the formation of a strong epoxy bond or other glue bond between the shaft of a golf club and the golf club main body.

Another aspect of the invention is the use of a two step moulding process which involves moulding the main body, with an opening for the front face. The next step involves moulding an insert to form a striking face on the front of the main body. In this way the main body can be made from a different material from the insert, allowing for a more specific and appropriate design. In particular to give the club good feel it is desired to form the main body of the club from a softer material, while to improve ball speed off of the club face and to achieve distance it is an aspect of this invention to form the insert from a harder material.

Therefore there is provided according to the present invention a golf club head comprising:

a main body moulded from a mouldable material having a first lower density;

means for weighting said main body, said weighting means having a second higher density and being positioned within said main body to enhance the striking characteristics of the main body;

a shaft receiving bore formed in the main body; and a shaft anchoring element proximate to said shaft receiving bore, said shaft anchoring element being moulded into said main body and being sized and shaped to receive a golf club shaft therein wherein said main body may be securely attached to a golf club shaft.

According to another aspect of the present invention there is provided a golf club head comprising:

a main body moulded from a mouldable material having a first lower density and a first hardness;

means for weighting said main body, said weighting means having a second higher density and being positioned laterally within said main body to enhance the striking characteristics of the main body when used as a club head;

a shaft receiving bore formed in the main body;

a shaft anchoring element proximate to said shaft receiving bore, said shaft anchoring element being moulded into said main body and being sized and shaped to receive a golf club shaft therein; and a moulded face insert having a second hardness which is greater than said first hardness.

According to yet a further aspect of the present invention there is provided a method of moulding a golf club head comprising:

a) positioning weights within a mould;

b) moulding a main body around said weights, including forming a shaft receiving bore in said main body;

c) forming a front insert receiving pocket on said main body;

d) inserting an insert into said insert receiving pocket; and e) finishing said club face.

BRIEF DESCRIPTION OF THE DRAWINGS

Reference will now be made, by way of example only, to preferred embodiments of the invention as illustrated in the attached drawings, in which.

DETAILED DESCRIPTION OF THE PREFERRED EMBODIMENTS

Figure 1:
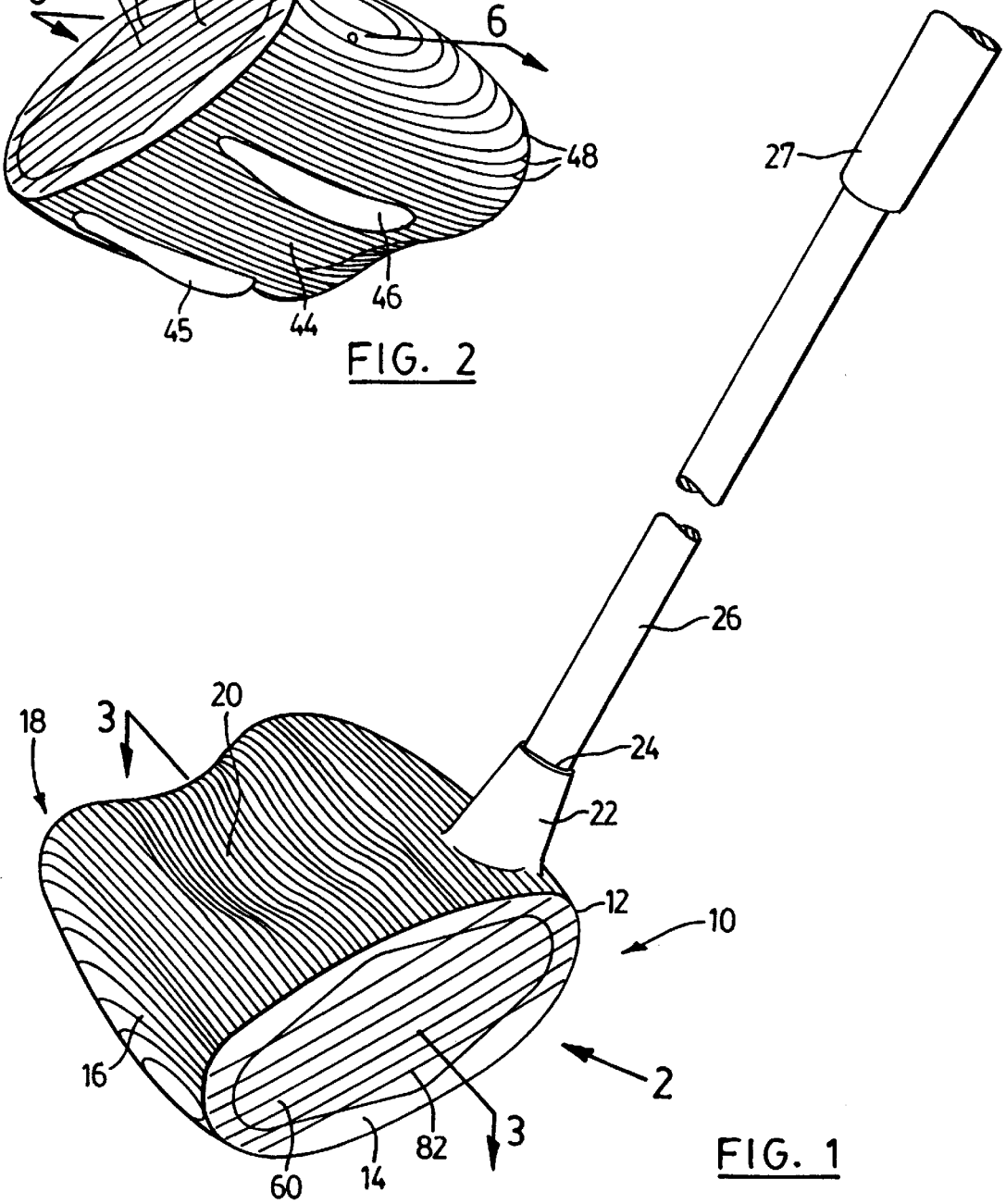
FIG. 1 is a perspective view of a golf club head according to the present invention attached to a shaft.

FIG. 1 illustrates a golf club head 10 according to the present invention. The golf club head 10 includes a moulded main body 12 which has a front ball striking face 14 and a rearwardly extending body portion 16. The body portion tapers as shown at 18 and includes an aerodynamic dimple 20. The dimple 20 is formed on the top side of the main body 12. The dimple 20 alters the air flow around the club and may help to reduce aerodynamic drag during use.

Also formed in the main body 12 is a hozzle 22 which surrounds a shaft receiving bore 24. As shown in FIG. 1, a shaft 26 having a grip 27 is inserted into the shaft receiving bore 24 to form a golf club. The attachment of the shaft 27 to the club head 10 is described in more detail below.

Figure 3:
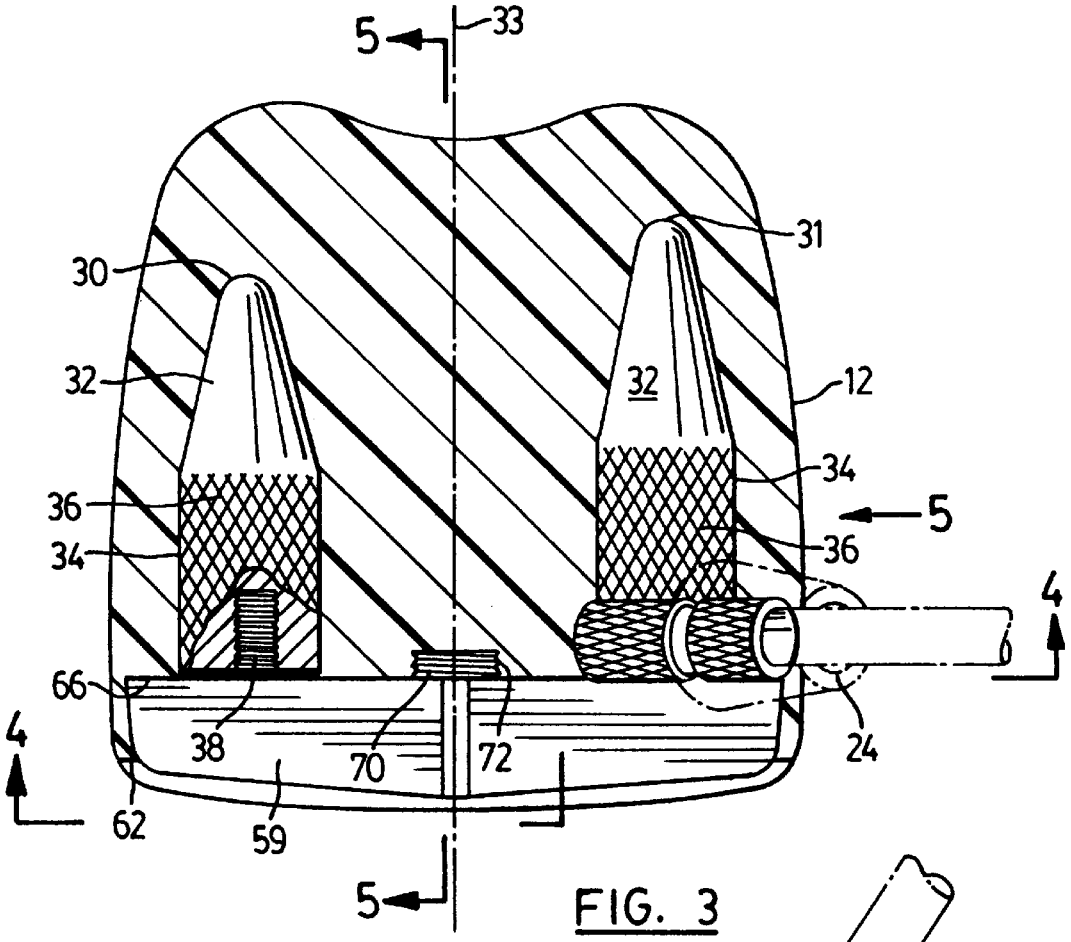
FIG. 3 is a sectional view of a partially completed golf club head of FIG. 1 along lines 3—3.

As shown in FIG. 3, included in the main body 12 are weight means 30, 31. Each weight means 30, 31 includes a tapered rearwardly extending portion 32 which may be in the shape of a bullet as illustrated. Each weight means 30 further includes a cylindrical section 34 which has an exterior surface 36 which is roughened to promote engagement and attachment between the moulded main body 12 and the weight means 30, 31. Most preferably, the surface 36 is knurled, to provide good surface interaction between the weight means 30 and the moulded main body 12.

Most preferably, the weight means 30, 31 are formed of a dense material, such as metal. Adequate results have been achieved with brass, although other metals or dense materials may also be used.

Figure 4:
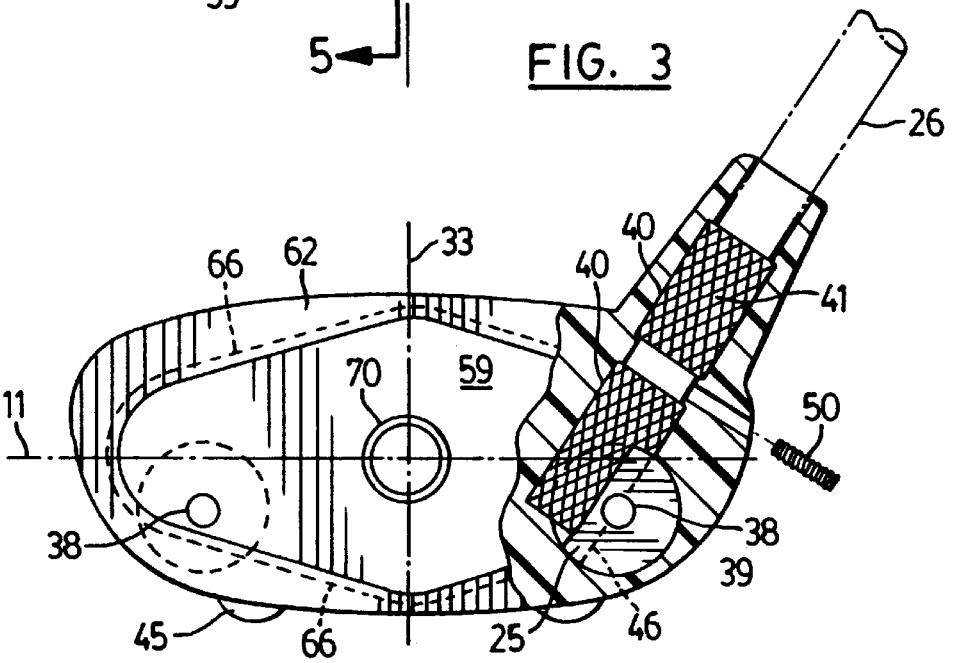
FIG. 4 is a front view of the partially fabricated golf club head of FIG. 3 according to the present invention.
Figure 5:
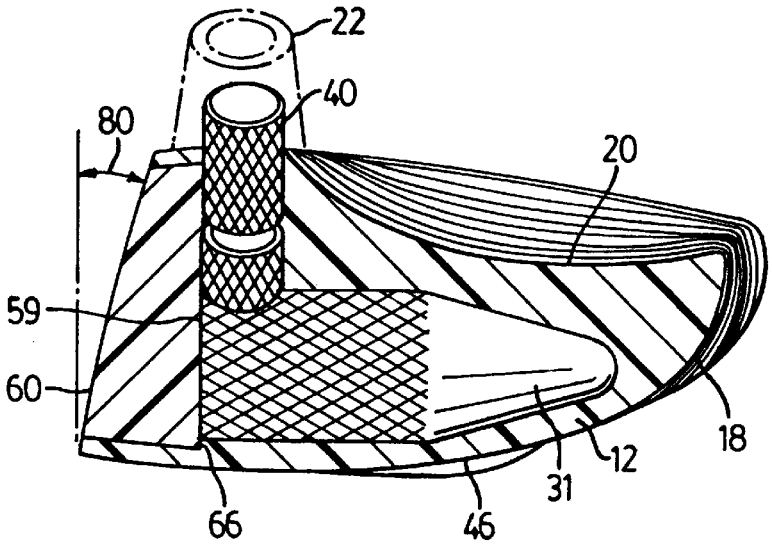
FIG. 5 is a view in part section in the direction of arrow 5 of the golf club head of FIG. 3 according to the present invention.

As seen in FIGS. 3 and 4, the weight means 30, 31 are preferably located on opposite sides of the club head 10, generally below the midline 11 of the club head and displaced laterally outwardly and inwardly from a central axis 33. In this manner, club head weight is concentrated outwardly, and downwardly. It is believed by concentrating the weight in these positions additional lift is provided to the ball as the centre of weight of the club head is low on the club face 14. As well this positioning of the weight means 30, 31 provides a higher mass moment of inertia about the central axis 33 of the club head 10, meaning that the club head 10 will tend to travel straighter even if the ball contact is made off centre. This has the desirable effect of maximizing the sweet spot of the club face 14 and reducing the tendency to hook or to slice the ball.

The weight means 30, 31 include a number of features which can now be described. The first feature, is the overall shape of the weight means. In order to provide an aesthetically pleasing and aerodynamic appearance to the club head 10, it is preferred to curve the club head in toward the rear. Thus, the club head 10 curves inwardly, from the sides, downwardly from the top and upwardly from the bottom. Additionally, as it is preferred to locate the weight means 30, 31 closely adjacent to the outer edge of the club, it is preferred to taper the rearward extension 32 of the weight means 30, 31 to permit the main body 12 of the golf club head 10 to taper. In other words, the rearward extension 32 of the weight means 30, 31 tapers in generally the same manner as the body, so that the lower weight means 30, 31 remains below the outer surface of the club head 10.

Additionally, the forward exterior surfaces 34 of the weight means 30, 31 are roughened to provide better surface adhesion and gripping contact between the weight means 30, 31 and the moulded main body 12. Good results have been achieved by knurling the outer surface of the weight means 30, 31 for that portion of the weight means 30, 31 prior to the taper on the rearwardly extending portion 32. When the mouldable material is poured into the mould around the peaks and valleys of the knurling, and sets, it securely locks the weights means 30, 31 in place.

A further feature of the weight means 30, 31 is formation of a mounting socket 38 on each weight means which has two functions. The first function is to provide a socket 38 for holding the weight means 30, 31 in place in the mould, when the moulded main body 12 is moulded around the weights. Most preferably therefore the socket 38 is provided with threads to form a releasable yet secure attachment to, for example, a mounting pin (not shown) which may form part of the mould (not shown). The pin allows the weights 30, 31 to be positioned in the mould, in exactly the correct position, and free from contact with any of the sides of the mould. Although good results have been achieved with a threaded socket 38, other forms of releasable connection for the mounting pin could also be used. The second function of the threaded socket 38 is that it provides a bonding anchor when the second moulding step takes place, as described more fully below.

It will also be noted that the shaft receiving bore 24 of the main body 12 extends into the body and intersects the weight means 31. Consequently the weight means 31 is provided with a mating curved surface 39 to permit the shaft receiving bore 24 to extend through toward the bottom of the club head 10. It will be appreciated that due to the removal of weight from this portion of the weight means 31, the weight means 31 must be made slightly longer than the weight means 30 if they are to have substantially the same weight. Thus the rearward portion of the weight means 31 extends slightly further backward, as shown in FIG. 3 than does the weight means 30.

It will now be appreciated that the formation of a curved opening 39 in the weight means 31 assists in the club head 10 integrity, since the club head 10 is stronger by means of the overlap between the shaft and the weight means 31. As can be seen in FIG. 4, the weight means 31 overlaps or curves around the front edge of the shaft 24 at 25 essentially forming a key way, which prevents front to back motion of the shaft 27 in bore 24.

It will also be appreciated that while reference is made in the drawings to cylindrical weights with bullet shaped ends, other shapes could also be used. For example, the weights could be thinner elements which more closely follow the curve of the side and bottom surfaces of the club head 10, in essence being shaped like brackets on either side. However, in such a case it would be more difficult to machine the weights than the preferred embodiment. The weights of the preferred embodiment are simply formed from standard brass rod or stock, and thus are easy and inexpensive to fabricate.

Figure 2:
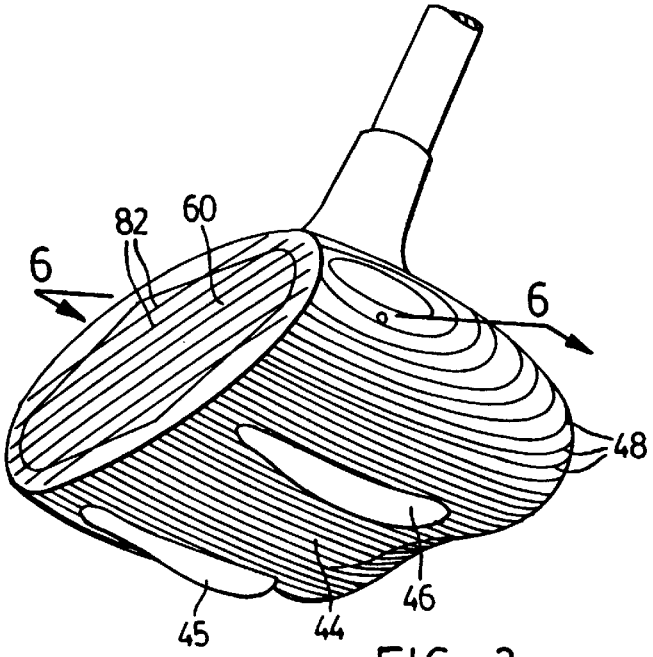
FIG. 2 is a further perspective view from below and to one side of the golf club head of FIG. 1 along lines 2—2.

In FIG. 2, the underside of a golf club head 10 according to the present invention is shown. It includes a bottom surface 44, which has two guiding ribs 45, 46. These guiding ribs extend out of the bottom surface 44 and are parallel to midline axis 33. Essentially, these guiding ribs 45, 46 act as rails to align the golf club head 10 in the event accidental contact is made with the ground during the swing. As such they are generally rounded and peaked, and taper from front to back. Although two are shown, more or fewer could be used.

Also visible in FIGS. 1 and 2 are surface ribs 48, which extend from the front to back faces. These ribs also help the aerodynamic action of the club head 10 during a golf swing. These surface ribs 48 are quite small, being only 0.2 mm high and are spaced between 1 and 10 mm apart. More or fewer ribs 48 could also be used.

Figure 6:
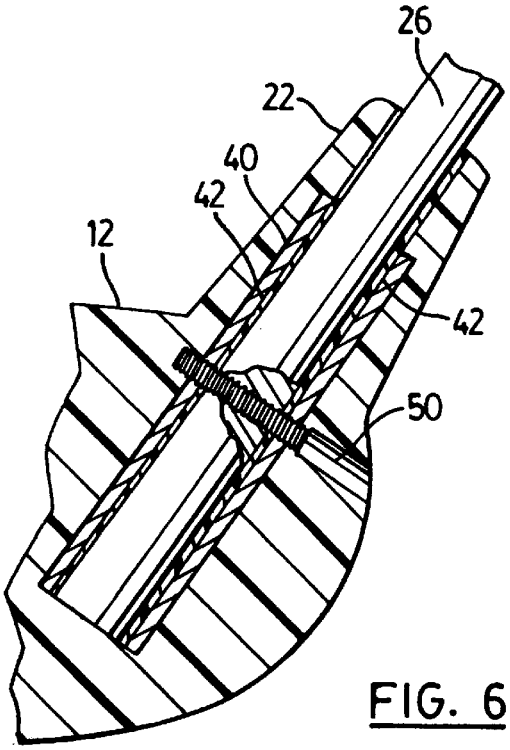
FIG. 6 is a detail view of a shaft attached to the golf club head according to a second embodiment of the present invention.

Turning now to the main body 12 the attachment of the shaft 27 to the main body 12 can now be more fully understood. In particular there is according to the present invention at least one shaft anchoring element 40. Most preferably the shaft anchoring element 40 takes the form of a tube of metal, such as aluminum, which is moulded into the main body 12. In the embodiment of FIG. 4 there are provided two such elements. In the embodiment of FIG. 6 there is provided only one such element. It will be appreciated by those skilled in the art that either would achieve the desired results.

A problem with prior moulded golf club heads has been to achieve a secure attachment to the shaft 26. This is because it is difficult to achieve a good bond between metal and most plastic composites of the type that have the properties suitable for being used as golf club heads. The present invention addresses this problem by eliminating the need to try to bond metal to cured plastic. Essentially the shaft anchoring element 40 is moulded into place around the shaft receiving bore 24 at the time the main body 12 is moulded.

The shaft anchoring element 40 can be any of a variety of shapes and configurations, provided that it on the one hand is securely anchored into the main body of the club head 10 such as by being moulded into the main body 12, and on the other hand permits the shaft 26 to be securely attached to it. Good results have been achieved through use of a tubular anchoring element 40. On the outside surface 41 of the tubular anchoring element is formed a roughened surface, by knurling or the like. As the liquid composite moulding material is poured or injected into the mould, the material fills into the surface features and then sets. Because of the peaks and valleys of the Knurling, the anchoring element 40 is therefore securely held in place in the moulded main body 12.

The inner surface of the tubular element is provided with a smooth bore, generally dimensioned to closely receive a shaft 26 therein. In this manner a secure adhesive bond can be formed between the inner face of the anchoring element 40 and the shaft 26, in a conventional manner. This epoxy or adhesive bond 42 is a metal to metal bond which has demonstrated sufficient adhesion in the past in the art.

To assist in completing a good bond and to further secure the club head 10 on the shaft 26 there is also provided an attachment screw 50 as shown in FIG. 6. The attachment screw 50 passes through the main body 12 generally perpendicularly to the shaft 26. The screw 50 passes through the anchoring element 40 and then onto the shaft 26 or preferably through the shaft 26 as shown in FIG. 6. In this way the screw 50 helps to provide resistance to the shaft 26 against the pull out force typically generated during a golf swing.

The method of making a club head 10 according to the present invention can now be described. Good results have been achieved with a two step moulding process. Moulding is preferred because it permits the use of a strong but light weight body material which in turn permits the weight means 30, 31 to be made as large as possible relative to the overall weight of the club head 10. In this manner more of the total weight of the club head 10 can be concentrated in a desirable position, namely low and toward the outer and inner side edges of the club head 10.

The preferred material is a mouldable composite, such as urethane. Most preferred the urethane should have a hardness of between 60 and 80 on the Durometer D hardness scale. Good results have been achieved with a hardness of between 68 and 72, with the most preferred hardness being about 70. Other mouldable materials may also be used, but urethane is preferred for its strength to weight ratio and its ease of moulding. What is desired is a mouldable material which is able to fill the full mould around the weight means 30, 31 and the anchoring element as described above without forming bubbles or pockets or the like. Good results have been achieved with the body being formed from Airthane PET 75D™ polyurethane intermediate from Air Products with ETHACURE 300™ curative from ELBAMARLE, and with the insert being formed from VERSATHANE 2180™ urathane prepolymer with VERSALINK 740M™ from Air Products.

The first moulding step according to the present invention is as follows. First, the weight means 30, 31 are positioned on mounting pins in a mould. Then the anchoring elements 40 are also positioned in the mould. Then a first charge of moulding composite is pushed or poured into the mould around the positioned elements. This is then allowed to cure thereby securely locking the various elements in place. Then the cured and partially moulded article is removed from the mould. At this point the club head is in the form as shown in FIGS. 3 and 4. There is formed on the front surface of the club head a pocket or socket 59 for receiving an insert. The back wall of the pocket is formed at the level of a front face of each of the weight means 30, 31. In this manner it is easy to remove the mounting pins from the weight means 30, 31. Then the pin receiving sockets are exposed and the club head is ready for the next moulding step.

In the next moulding step an insert 60 is moulded into the front face 14 of the club head 10. Although a metal to plastic bond is difficult to achieve, a plastic to plastic bond is not.

Therefore, the insert 60 can also be formed from moulded composite and will form a secure bond to the already portion moulded club head 10. However to assist in the structural integrity of the finished product certain other features are provided.

For example after the first moulding step there is a wall or lip 62 formed around the outside of the front face 14. This wall 62 forms the cavity or pocket 59 into which the insert 60 is moulded. To ensure the best fit of the insert into the club head 10, this wall 62 is undercut in the nature of a dovetail as shown at 66. Thus when the insert material is poured into the front face 14, it will be larger in area at the back of the insert 60 than toward the front face 14 which will have the effect of keeping the insert 60 securely in the club head 10.

There are two steps to forming the insert pocket 59. The first is to use a mould plate which forms some of the pocket 59 at the time the balance of the club head 10 is made. However this is only an intermediate step. The next step is to machine the outer sides of pocket 59 to form the lip on wall 62 with the dovetail or under cut 66. In this way it is easy to form the undercut lip and to ensure a good surface for attachment of the insert 60. Of course it is necessary to ensure that the pocket 59 is clean and without debris before moulding the insert 60 therein.

In addition the mounting pin receiving sockets 38 formed on the weight means 30, 31 will also be filled with insert material as the insert pocket 59 is filled. When hardened into the sockets 38 this will assist in forming a strong connection between the insert 60 and the balance of the club head 10 by acting as bonding anchors as discussed above. Lastly there is also formed a central threaded opening 70 which acts in the same manner as a larger bonding anchor. Once the insert material is poured into this opening and hardens, the threads 72 in opening 70 will also act to keep the insert in place.

The last step in the process of making the club head 10 is to finish the outer face. This is most preferably done by machining after the insert is cured. For example on a CNC machine, can be used to remove any excess material and to cut the exact front face loft 80 desired. Also, the front face grooves 82 can be cut into the face.

It can now be appreciated that the insert 60, while also being a mouldable material can be of a different material from the main body 12. In particular the material can have a higher hardness than the main body 12. The hardness of the insert can range between 70 and 110, with the most preferred hardness being about 80 on the Durometer D scale. Having a hard insert has certain advantages. Firstly, the insert must have a minimum hardness to meet U.S.G.A. rules. Secondly a harder insert will provide a more efficient bounce off the club face, since the harder the material is the less energy is lost in deformation. On the other hand providing an insert which is too hard is undesirable, as harder material is generally more brittle and thus prone to failure. Additionally a harder insert reduces the feel of the club, which is undesirable. Thus the preferred range of hardness is between 75 and 85, with the most preferred hardness being about 80.

A golf club head 10 made according to the present invention can be exactly controlled and made to precise specifications. Unlike traditional woods made from wood, whose density and strength characteristics can vary from piece to piece, every club head made according to the present invention will be dimensionally and functionally identical, to a very high degree of precision. In addition to allowing for the weight concentration as described, with its beneficial effects on the swing and impact dynamics, there is also an ease of manufacturing. It may be less expensive to mould club heads out of the desired composite, than if made from metal or wood.

The use of a light weight body with concentrated weights also allows for an enlarged sweet spot without an enlarged club head. A smaller club head with a smaller club face has a number of advantages. Firstly, the smaller club head will have less drag than a larger club head. Thus, it will be marginally easier to swing and accelerate into the ball contact position. More importantly, a smaller club head will be much less prone to being stopped, for example, by grass, in the event a shot is being made out of the rough. A smaller club head will not encounter as much grass, reducing the resistance to the swing by the grass and making it easier to hit a ball out of the rough. Again, this advantage arises because of the smaller surface required to form a larger sweet spot, according to the present invention. Ideally the club face has a maximum height in a three wood of 1.35" and a maximum width of 3.05". This, because of the rounded corners, results in a three wood club face that is less than about 4.00 square inches in area, or even slightly less, between 3.5 square inches and 3.75 square inches in area.

It can now be appreciated that the present invention teaches a club head which can be made easily and efficiently, and most importantly, almost exactly identical every time. Unlike a casting process, which may have manufacturing variations, or using wood, which has notoriously variable properties, the present invention can be made from the exact same material to extremely tight tolerances. Thus, every club should be very close to the same.

It will be appreciated by those skilled in the art that the foregoing description is in respect of preferred embodiments of the invention only, and that other variations are possible without departing from the broad scope of the present invention. For example, while the preferred method of forming the insert is through moulding, other ways of attaching an insert might also be used. Also, other materials could be used for the insert if desired, such as metals, wood or the like. However, such elements are less preferred, because they will not be as easy to attach to the club face as the preferred moulded insert.

I claim:

1. A golf club head comprising:

a main body moulded from a mouldable material having a first lower density;

an insert moulded into a face of main body to form a striking surface;

means for weighting said main body, said weighting means having a second higher density and being positioned within said main body to enhance the striking characteristics of the main body;

a shaft receiving bore formed in the main body; and a shaft anchoring element proximate to said shaft receiving bore, said shaft anchoring element being moulded into said main body and being sized and shaped to receive a golf club shaft therein to securely attach a golf club shaft to said main body.

2. A golf club head as claimed in claim 1 wherein said mouldable main body is made from urethane.

3. A golf club head as claimed in claim 1 wherein said weighting means is made from metal.

4. A golf club head as claimed in claim 1 wherein said weighting means is made from metal and comprises a pair of opposed weights located generally symmetrically about a central axis of said main body, toward lateral side edges of said main body.

5. A golf club head as claimed in claim 4 wherein each weight includes a forward portion and a tapered rearward portion.

6. A golf club head as claimed in claim 5 wherein said weights include means for bonding to said moulded main body.

7. A golf club head as claimed in claim 6 wherein said bonding means comprises knurling on at least a portion of an outside of the weight.

8. A golf club head as claimed in claim 1 wherein said shaft anchoring element is metal and is moulded into said main body.

9. A golf club head as claimed in claim 8 wherein said shaft anchoring element includes a shaft receiving section for closely receiving a shaft therein to permit the formation of a bond between the shaft anchoring element and the shaft wherein said shaft is secured within said club head.

10. A golf club head as claimed in claim 9 wherein said shaft anchoring element includes a roughened surface to facilitate the bonding of said shaft anchoring element into said main body.

11. A golf club head as claimed in claim 10 wherein said shaft anchoring element includes an aperture for a set screw.

12. A golf club head as claimed in claim 10 wherein said shaft anchoring element is a tube of aluminium, and has an outer surface and an inner surface, wherein said outer surface is knurled to promote adhesion to said moulded main body and said inner surface is smooth to promote adhesion to said shaft.

13. A golf club head as claimed in claim 1 wherein said insert is moulded and is comprised of a material having a different hardness than said main body.

14. A golf club head as claimed in claim 13 wherein said insert has a higher hardness than said main body.

15. A golf club head as claimed in claim 14 wherein said insert is formed from moulded urethane and is tapered outwardly from front to back to retain said insert in place.

16. A golf club head as claimed in claim 15 wherein said weights are positioned in said moulded main body to extend rearwardly from an interface between said insert and said main body.

17. A golf club head as claimed in claim 1 wherein said moulded main body is formed with a front insert receiving pocket.

18. A golf club head as claimed in claim 1 further including aerodynamic ridges which extend from the front of the club head to the rear of the club head.

19. A golf club as claimed in claim 18 wherein said main body includes a rearwardly extending dimple on a top surface thereof.

20. A golf club head as claimed in claim 1 wherein said moulded main body includes at least one ridge extending parallel to the axis of movement of the club in use extending from a lower surface thereof.

21. A golf club head as claimed in claim 20 wherein said moulded main body includes two of said ridges.

22. A golf club comprising a golf head having a main body moulded from a mouldable material having a first lower density;

an insert moulded into a face of main body to form a striking surface;

means for weighting said main body, said weighting means having a second higher density and being positioned within said main body to enhance the striking characteristics of the main body;

a shaft receiving bore formed in the main body; and a shaft anchoring element proximate to said shaft receiving bore, said shaft anchoring element being moulded into said main body and being sized and shaped to receive a golf club shaft therein to securely attach a golf club shaft to said main body a golf club shaft secured to said golf club head and a grip secured to said golf club shaft.

23. A golf club head comprising:

a main body moulded from a mouldable material having a first lower density and a first hardness;

means for weighting said main body, said weighting means having a second higher density and being positioned laterally within said main body to enhance the striking characteristics of the main body when used as a club head;

a shaft receiving bore formed in the main body; and a moulded face insert on said main body having a second hardness which is greater than said first hardness and which forms a striking surface on said golf club head.

24. A golf club head as claimed in claim 23 wherein said means for weighing said main body extends rearwardly in said main body from an interface between the main body and the moulded insert.

25. A golf club head as claimed in claim 23 wherein said first hardness is in the range of 60 to 75 on the Durometer D scale and said second hardness is in the range of 80 to 90 on the Durometer D scale.

* * * * *